US008442247B2

(12) United States Patent
Lamm et al.

(10) Patent No.: US 8,442,247 B2
(45) Date of Patent: May 14, 2013

(54) HEARING AID SYSTEM COMPRISING A MATCHED FILTER AND A MEASUREMENT METHOD

(75) Inventors: Jesko Lamm, Berne (CH); Lukas Maurer, Berne (CH); Michael Ernst, Berne (CH); Sarah Bostock, Berne (CH)

(73) Assignee: Bernafon AG, Berne (CH)

( * ) Notice: Subject to any disclaimer, the term of this patent is extended or adjusted under 35 U.S.C. 154(b) by 1071 days.

(21) Appl. No.: 12/332,103

(22) Filed: Dec. 10, 2008

(65) Prior Publication Data

US 2009/0147977 A1 Jun. 11, 2009

(30) Foreign Application Priority Data

Dec. 11, 2007 (EP) ..... 07122823

(51) Int. Cl.
*H04R 25/00* (2006.01)

(52) U.S. Cl.
USPC ..... 381/315; 381/23.1; 381/312; 381/313; 381/314; 381/328

(58) Field of Classification Search ..... 381/315, 381/23.1, 312, 313, 314, 328
See application file for complete search history.

(56) References Cited

U.S. PATENT DOCUMENTS 3,662,108 A * 5/1972 Flanagan ..... 704/228
4,622,440 A 11/1986 Slavin
4,790,019 A * 12/1988 Hueber ..... 381/315
4,845,755 A 7/1989 Busch et al.
4,878,188 A * 10/1989 Ziegler, Jr. ..... 708/300
4,918,736 A * 4/1990 Bordewijk ..... 381/315

(Continued)

FOREIGN PATENT DOCUMENTS

EP 1 322 138 A2 6/2003
EP 1 926 343 A1 5/2008
WO WO-99/12388 A1 3/1999
WO WO-2007/028250 A2 3/2007

OTHER PUBLICATIONS

A. M. Engebretson et al., "Two DSP-Based Vibrotactile Hearing Devices", Implants, Tactile Aides and Auditory Aids, Nov. 9, 1989, pp. 1069-1070, Engineering in Medicine & Biology Society.

(Continued)

*Primary Examiner* — Fernando L Toledo
*Assistant Examiner* — Mohammed Shamsuzzaman
(74) *Attorney, Agent, or Firm* — Birch, Stewart, Kolasch & Birch, LLP

(57) ABSTRACT

The invention relates to a hearing aid system comprising an input transducer for converting an input sound signal comprising an information signal part of a known waveform and a background noise part to an electrical analogue input signal, optionally an A/D converter for converting the electrical input signal to a digital input signal. The invention further relates to a method of making a critical gain measurement. The object of the present invention is to improve the signal-to-noise ratio of a signal to be measured or detected in a hearing instrument compared to prior art solutions. The problem is solved in that a matched filter receiving said analogue or digital input signal and optimized to improve the identification of the information signal part from the noisy input signal. An advantage of the invention is that it provides an alternative scheme for improving signal to noise ratio of a hearing aid. The invention may e.g. be used for the customization of hearing aid parameters in cooperation with fitting software and/or for improving signal to noise ratio of a detected or measured signal.

29 Claims, 3 Drawing Sheets

U.S. PATENT DOCUMENTS

| | | | | |
|---|---|---|---|---|
| 5,604,812 | A * | 2/1997 | Meyer | 381/314 |
| 5,812,682 | A * | 9/1998 | Ross et al. | 381/71.11 |
| 5,825,894 | A * | 10/1998 | Shennib | 381/60 |
| 5,910,997 | A * | 6/1999 | Ishige et al. | 381/314 |
| 5,944,672 | A | 8/1999 | Kim et al. | |
| 6,134,329 | A | 10/2000 | Gao et al. | |
| 6,272,229 | B1 * | 8/2001 | Baekgaard | 381/313 |
| 6,498,858 | B2 | 12/2002 | Kates | |
| 6,611,600 | B1 * | 8/2003 | Leber et al. | 381/66 |
| 6,785,394 | B1 * | 8/2004 | Olsen et al. | 381/312 |
| 7,010,132 | B2 * | 3/2006 | Luo et al. | 381/312 |
| 7,058,182 | B2 * | 6/2006 | Kates | 381/60 |
| 7,231,055 | B2 * | 6/2007 | Uvacek et al. | 381/312 |
| 7,463,745 | B2 * | 12/2008 | Miller, III | 381/318 |
| 7,474,755 | B2 * | 1/2009 | Niederdrank | 381/92 |
| 7,474,758 | B2 * | 1/2009 | Beck et al. | 381/313 |
| 7,496,206 | B2 * | 2/2009 | Husung | 381/312 |
| 7,716,046 | B2 * | 5/2010 | Nongpiur et al. | 704/226 |
| 7,774,201 | B2 * | 8/2010 | Yamada | 704/225 |
| 7,933,423 | B2 * | 4/2011 | Baekgaard Jensen et al. | 381/312 |
| 8,096,937 | B2 * | 1/2012 | Miller, III | 600/25 |
| 2002/0018572 | A1 * | 2/2002 | Rhoads | 381/1 |
| 2002/0159604 | A1 * | 10/2002 | Eastty et al. | 381/94.1 |
| 2004/0057591 | A1 * | 3/2004 | Beck et al. | 381/315 |
| 2004/0202333 | A1 | 10/2004 | Csermak et al. | |
| 2005/0041824 | A1 * | 2/2005 | Arndt et al. | 381/313 |
| 2005/0069163 | A1 * | 3/2005 | O'Brien | 381/314 |
| 2005/0117764 | A1 * | 6/2005 | Arndt et al. | 381/315 |
| 2005/0207602 | A1 * | 9/2005 | van Oerle | 381/312 |
| 2006/0050911 | A1 | 3/2006 | Von Buol | |
| 2006/0245610 | A1 | 11/2006 | Chalupper | |
| 2008/0123882 | A1 | 5/2008 | Bauml et al. | |
| 2010/0303250 | A1 * | 12/2010 | Goldberg et al. | 381/59 |

OTHER PUBLICATIONS

M. Bertges-Reber, "Boundaries of real open fittings: Clinical experiences," Tech Topic, Feb. 1, 2006, pp. 44-47, vol. 13, No. 2, The Hearing Review, Allied Healthcare Group, US.

W. L. Melvin, "A STAP Overview," Part 2: Tutorials-Melvin, Jan. 2004, pp. 19-35, vol. .19, No. 1, IEEE A&E Systems Magazine.

G. L. Turin, "An Introduction to Matched Filters," IRE Transactions on Information Theory, Jun. 1960, pp. 311-329, vol. 6, No. 3, PGIT, Hughes Research Laboratories, Malibu, CA.

M.D. Hahm et al., "A Comparison of Analog and Digital Circuit Implementations of Low Power Matched Filters for Use in Portable Wireless Communication Terminals," IEEE Transactions on Circuits and Systems-II: Analog and Digital Signal Processing, Jun. 1997, pp. 498-506, vol. 44, No. 6, IEEE, Inc.

J.G. Proakis et al., "Digital Signal Processing: Principles, Algorithms, and Applications," 1996, pp. 623-630, 3rd Edition, Prentice Hall, Upper Saddle River, New Jersey.

* cited by examiner

HEARING AID SYSTEM COMPRISING A MATCHED FILTER AND A MEASUREMENT METHOD

TECHNICAL FIELD

The invention relates to a scheme for improving signal to noise ratio in a hearing aid (HA, also interchangeably termed 'Hearing Instrument' (HI) in the following). The invention further relates to a method of making a critical gain measurement. The invention relates specifically to a hearing aid system, to a method and use.

The invention may e.g. be useful for the customization of hearing aid parameters in cooperation with fitting software and/or for improving signal to noise ratio of a detected or measured signal.

BACKGROUND ART

Signal detection and measurements play an important role in the application of Hearing Instruments. Among other things, they allow us to collect information about the different acoustic environments in which a Hearing Instrument is worn, to assess Hearing Instrument performance, to collect the data needed for user-specific Hearing Instrument adjustments and to verify that the Hearing Instrument operates properly after a repair.

Sometimes the Hearing Instrument itself can carry out all, or part of a measurement procedure. Using the Hearing Instrument, rather than an external device, to perform a measurement often brings significant benefits, as in the case of measuring the so-called individual threshold of feedback (also called "Critical Gain"). The individual threshold of feedback is a measure of the gain limitations that should be taken into account in order to reduce unwanted whistling sounds, and this threshold is unique for every hearing instrument fitting.

In existing solutions for measuring the individual threshold of feedback, an acoustic test signal is picked up by the Hearing Instrument's microphone and fed directly into a level meter or similar device (cf. e.g. M. Bertges-Reber, Boundaries of real open fittings: Clinical experiences, *Hearing Review*, Vol. 13, No. 2, February 2006, page 44-47). Such procedures are inaccurate in the presence of background noise. It is almost impossible to eliminate background noise in all cases because these measurements must be carried out while the Hearing Instrument is being worn. There are two main reasons for the inaccuracy of such procedures, both of which are related to the ratio between the signal to be measured and the unwanted background noise (signal-to-noise ratio):

- Background noise can be very loud, resulting in a poor signal-to-noise ratio.
- In order to avoid signals being uncomfortably loud for the Hearing Instrument wearer it may be necessary to limit the output level of the acoustic test signal. This also compromises the signal-to-noise ratio.

The present invention addresses both of the above potential causes of inaccuracy.

DISCLOSURE OF INVENTION

The general idea is to apply the "matched filter" concept (which is taken from telecommunications engineering) to audio processing in Hearing Instruments (HI), with particular focus on

- detecting signals of known waveform and/or
- measuring signal levels of signals with known waveform.

A matched filter is capable of identifying a signal of known waveform from noise, even if the signal-to-noise ratio is very poor, cf e.g. W. L. Melvin, IEEE A&E Systems Magazine, Vol. 19, No. 1, January 2004, page 19-35 or G. L. Turin, IRE Transactions on Information Theory, Vol. 6, No. 3, June 1960, page 311-329. A comparison of analogue and digital implementations of matched filters is e.g. given in Hahm, M. D.; Friedman, E. G.; Titlebaum, E. L.: A Comparison of Analog and Digital Circuit Implementations of Low Power Matched Filters for Use in Portable Wireless Communication Terminals, *IEEE Transactions on Circuits and Systems-II*, Volume 44, Issue 6, June 1997, page 498-506

An idealized matched filter is a delay-free linear time-invariant system with one input and one output. When matched to a given waveform s(t), an ideal matched filter has an impulse response that equals s(−t). In consequence, the filter's output is produced by cross-correlating its input signal with a given waveform s(t). That means that for an input of s(t) the filter outputs the auto-correlation function of s(t). However the filter attenuates all signals with waveforms different from s(t). If s(t) is the filter's input signal then we can measure its level by feeding the output of the matched filter into a level meter. The filter attenuates background noise, improving measurement accuracy. An ideal matched filter is a non-causal system and cannot be implemented. However, one can implement a sufficient approximation of the idealized matched filter by introducing a time delay, and if s(t) is periodic, by limiting the length of the signal to correlate with. We can use windowing techniques to generate a fragment of s(t) short enough to be correlated with the input signal of the filter.

In the following, the term "matched filter" will denote a feasible implementation that approximates an idealized matched filter.

An object of the present invention is to improve the signal-to-noise ratio of a signal to be measured or detected in a hearing instrument compared to prior art solutions.

Objects of the invention are achieved by the invention described in the accompanying claims and as described in the following.

A Hearing Aid System:

An object of the invention is achieved by a hearing aid system comprising an input transducer for converting an input sound signal comprising an information signal part of a known waveform and a background noise part to an electrical analogue input signal, optionally an A/D converter for converting the electrical input signal to a digital input signal, and a matched filter receiving said analogue or digital input signal and optimized to improve the identification of the information signal part from the noisy input signal. The noisy input signal refers to the electrical input signal originating from an input sound signal comprising an information signal (signal of interest) mixed with background noise—possibly from natural (e.g. voices) or man-made (e.g. machines) sources and acoustic feedback from the acoustic output of the hearing aid itself.

In the present context, the term "waveform" is taken to mean the function of time describing the instantaneous amplitude of the signal over a limited time interval. The extension of the limited time interval is in practice dependent on the application in question, whether the system is in a measurement or a normal configuration. In an embodiment, a limited time interval is in the range from 0.2 milliseconds to 20 milliseconds, such as 1 millisecond.

An advantage of the invention is that it provides an alternative scheme for improving signal to noise ratio of a hearing aid.

In an embodiment, the hearing aid system comprises a signal path comprising a signal processing unit for processing the digital input signal—at least for adapting the digital input signal to a user's hearing profile—and for providing a processed output signal. The signal path (also termed the forward path) comprises the signal picked up by the input transducer to be processed by the signal processing unit and the components for processing the signal to be presented (e.g. via an output transducer) as an audio signal adapted to a user's needs.

In an embodiment, the hearing aid system comprises a D/A converter for converting a processed output signal to an analogue electrical output signal. A predefined sampling rate, e.g. between 5 and 20 kHz, can be used to create frames of digitized signal values of amplitude versus time comprising values at specific points in time, corresponding to $n\cdot(1/f_s)$ where $f_s$ is the sampling frequency and n=1, 2, 3, . . . In an embodiment, the electrical input signal is split into a number of frequency bands (e.g. 4 or 8 or 16 or more) that are treated individually. In an embodiment, the frequency range considered is between 0 and 20 kHz, such as between 10 Hz and 10 kHz. In an embodiment, frames of digitized values of amplitude versus time are generated for each frequency band (and for a number of discrete frequencies in each band), thereby generating a digital time-frequency matrix.

In an embodiment, the hearing aid system comprises an output transducer, such as a receiver, for converting a digital or analogue electrical output signal to an output sound signal.

In an embodiment, the hearing aid system comprises a signal generator for generating a predefined source signal s(t). In an embodiment, the predefined source signal s(t) is periodic in time, e.g. comprising a sine and/or cosine signal (e.g. $s(t)=\sin(\omega_0\cdot t)$, $\omega_0=2\cdot\pi\cdot f$, where f is the frequency).

In an embodiment, the hearing aid system is adapted to provide that the source signal can be added to the output of the signal processing unit, e.g. via a digital SUM-unit, possibly controlled by a switch for enabling or disabling the source signal from the signal generator to the SUM-unit.

In an embodiment, the hearing aid system is adapted to provide that the source signal can be connected directly to the D/A converter or output transducer, e.g. by disabling the input to the SUM-unit from the signal processing unit. In this mode, the hearing aid system can be used to generate a predefined output sound signal which can be used in measurements of specific parameters of the hearing aid in the current 'natural setting' consisting of the actual user's ear a specific acoustical environment.

In an embodiment, the signal generator is adapted to generate a signal with a predefined waveform s(t). In an embodiment, the matched filter is adapted to have an impulse response of a predefined shape $s(-t+\Delta t)$ for a certain range of t, where $\Delta t$ is a certain time delay. Thereby, the matched filter is adapted to provide the auto-correlation function of s(t) as an output. In an embodiment, $\Delta t$ is of the order of (such as +/−50% of, such as substantially equal to) the group delay of the matched filter. This signal can be used in the further processing e.g. to extract information about the acoustic feedback path, to adjust parameters of the signal processing, including to improve feedback cancellation.

In an embodiment, the hearing aid system comprises an alternative path comprising the matched filter. The term 'alternative path' is taken to mean an electrical signal path that is parallel to the 'normal forward path' from input to output transducer in a listening device, at least over a part of its extension, the forward path typically comprising a signal processing unit for providing a frequency dependent gain. The 'alternative path' is a processing path for processing a signal that is branched off from the forward path (e.g. based on the digital input signal). In an embodiment, the digital input signal from the A/D converter is fed to the matched filter. In an embodiment, the electrical analogue input signal is split into frequency bands by a filter bank prior to A/D conversion. In an embodiment, the splitting of the signal into frequency bands is based on the digitized signals (i.e. after A/D-conversion). In both cases, a frequency split signal comprising individual frequency bands is fed to the matched filter (or filters) and processed individually.

In an embodiment, the alternative path further comprises a detection unit for evaluating the signal from the matched filter. In an embodiment, the output of the matched filter is fed to the detection unit. In an embodiment, the output of the detection unit is connectable to the signal processing unit for further evaluation.

In an embodiment, the signal processing unit is connectable to the signal generator to allow the signal generator to be controlled from the signal processing unit.

In an embodiment, the hearing aid system further comprises a programming interface to an external programming unit, e.g. a personal computer. The programming unit can be a handheld unit or a PC. This has the advantage that the hearing aid system can be in communication with fitting software running on the programming unit, whereby measurements made fully or partially by the hearing aid can be managed processed and displayed via the programming unit. Possible consequential changes to the signal processing to better adapt the input signal to the user's hearing profile (e.g. gain parameters, compression, etc.) can subsequently be uploaded to the hearing aid and immediately tried out.

In an embodiment, the output of the detection unit is connectable to the external programming unit via the programming interface. In an embodiment, the signal generator is connectable to the external programming unit via the programming interface. This has the advantage of allowing fitting software running on the programming unit to monitor and/or control and/or display the generated and detected signals in the hearing aid.

In an embodiment, the detection unit comprises an evaluation part for evaluating the detected signal from the matched filter to identify the current acoustic environment of the hearing aid system, possibly based on a comparison with values of the detected signal from the matched filter for pre-defined acoustic environments stored in a memory. Frames of digital values of the signal from the matched filter and/or from the detection unit corresponding to specific acoustical environments can be stored in a memory of the hearing aid system. The current values can be compared with stored values to detect the set of values that most closely resembles the current set, thereby indicating the most closely resembling acoustical environment (among the ones for which values are stored).

In an embodiment, the hearing aid system further comprises a control unit for—based on the output of the detection unit—modifying the adaptation of the input signal to a user's hearing profile performed by the signal processing unit. This can e.g. be done by determining the most closely resembling acoustical environment and selecting a corresponding set of parameters for the signal processing OR by modifying one or more of the parameters for the signal processing in accordance with predefined criteria.

In an embodiment, the control unit is adapted to switch the hearing aid system into a low power mode based on predefined criteria. Such predefined criteria may include a comparison of current output signals from the detector with stored ones for 'active acoustic environments'. A 'low power mode' can e.g. be a mode where power consumption is significantly reduced compared to normal operation, e.g. reduced to less than 20% or less than 10% or less than 5% of the normal consumption. Thereby power can be saved when the hearing aid system is not in use. In an embodiment, power can automatically be switched totally off. A manual on/off option is further provided.

In a particular embodiment, the hearing aid system comprises a body-worn hearing instrument and a remote control for controlling functions of the hearing instrument, wherein the remote control comprises a signal generator adapted for generating an acoustic signal of known waveform in a frequency range inaudible to the human ear. This has the advantage of utilizing the already existing components of the hearing aid system for the implementation of the receiver-part of the remote control system. It further provides an alternative wireless transmission form to the otherwise typically used forms, e.g. radio frequency, infra red light, inductive.

In an embodiment, the hearing instrument is adapted to identify the known waveform of the remote control signal from the sound picked up by its input transducer and react to it by modifying its behaviour, e.g. by changing a parameter setting, e.g. volume.

In an embodiment, the hearing instrument comprises a matched filter in combination with a level detector and a 1-bit quantizer for identifying the remote control signal.

In an embodiment, the signal generator of the remote control is adapted to transmit signals of different waveforms representing different remote control commands.

In an embodiment, the hearing instrument comprises different matched filters to distinguish the different remote control commands, each filter being matched to the waveform assigned to a single remote control command.

Critical Gain Measurement Method:

In an aspect, the invention provides a method of making a Critical Gain measurement on a hearing aid, the hearing aid comprising an input transducer for converting an input sound signal to an electrical input signal and an output transducer for converting a processed electrical output signal to a processed sound output, the method comprising, providing a predefined sound output from the hearing aid on the basis of a predefined electrical signal from a signal generator;

providing a matched filter for filtering the predefined sound output as received by the input transducer and providing a filtered input signal;

determining the critical gain of the hearing aid on the basis of the filtered input signal from the matched filter and the predefined electrical signal from the signal generator.

In a further aspect, a method of making a Critical Gain measurement on a hearing aid is provided, the hearing aid comprising an input transducer for converting an input sound signal to an electrical input signal and an output transducer for converting a processed electrical output signal to a processed sound output, the method comprising Generating a sound with a predefined waveform s(t), a predefined output level $P_o$ at the output transducer of the hearing aid and a predefined frequency or bandwidth;

Measuring the input level $P_i$ of the generated sound at the input transducer as determined by the level of the electrical input signal from the input transducer of the hearing aid;

Determining the Critical Gain at the frequency or in the frequency band of the generated sound as the difference $P_o$-$P_i$ between the output and input levels, where the Critical Gain is defined as the maximum difference between the output and input sound levels above which the hearing aid starts to howl due to acoustic feedback;

Varying the frequency or frequency band of the generated sound to obtain a relationship between frequency and Critical Gain;

wherein measuring the input level $P_i$ of the generated sound at the input transducer uses a matched filter, which is adapted to receive the generated sound by having an impulse response that is $s(-t+\Delta t)$ for a certain range of t, where $\Delta t$ is a certain time delay. In a typical application, $\Delta t$ would be the in the order of (such as equal to) the group delay of the matched filter. For example, $\Delta t$ would equal 1 millisecond, if the matched filter was implemented by a linear-phase digital filter with a group delay of 40 samples operating at a sampling rate of 40 kHz and with a negligible delay for conversions like analogue-to-digital conversion.

In an embodiment, the predefined waveform s(t) is periodic in that $s(t)=s(t+m\cdot T_0)$, where m is an integer and $T_0$ is a time period. In an embodiment, the predefined waveform s(t) is a sine or cosine signal, e.g. $s(t)=\sin(\omega_0\cdot t)$, $\omega_0=2\cdot\pi\cdot f_0$, where $f_0$ is the frequency. In that case, the time period $T_0$ equals $2\cdot\pi/\omega_0$. In an embodiment, the sound with a predefined waveform s(t) is generated by a signal generator in the hearing aid.

In an embodiment, the hearing aid comprises a signal path comprising a signal processing unit for adapting the input signal to a user's hearing profile and an alternative path comprising the matched filter. It is intended that other features of a hearing aid as described above under the heading "A hearing aid system" and as described in the section "Mode(s) for carrying out the invention" can be combined with the present method.

In an embodiment, the method comprises communication with a programming unit, e.g. a personal computer, whereon fitting software runs and from which the gain measurement can be controlled. This has the advantage of allowing the fitting software to monitor and/or control and/or display the generated and detected signals in the hearing aid and to modify processing parameters of the hearing aid in consequence of the measurements.

In an embodiment, the method comprises providing that a signal from the matched filter is evaluated in a detector unit, such as a level detector.

In an embodiment, the method comprises providing that the output of the detector unit is evaluated in (e.g. used as an input to an evaluation block in) the signal processing unit with a view to the current acoustic environment. In an embodiment, the method comprises modifying the signal processing according to the result of the comparison.

In an embodiment, the method comprises that characteristics of relevant acoustic environments are stored, e.g. in the signal processing unit, for comparison with current values of the detector signal and wherein one or more signal processing parameters (of the signal processing unit for providng a frequency dependent gain) can be modified based on such comparison and predefined criteria. Thereby changes in the feedback path can be assessed and compensated during normal use of the hearing instrument.

In an embodiment, the method comprises providing to switch the hearing aid system into a low power mode based on pre-defined criteria, such as a comparison of current output signals from the detector unit with stored ones for active acoustic environments. Thereby power can be saved when the hearing aid system is not in use.

Further objects of the invention are achieved by the embodiments defined in the dependent claims and in the detailed description of the invention.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can either be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

BRIEF DESCRIPTION OF DRAWINGS

The invention will be explained more fully below in connection with a preferred embodiment and with reference to the drawings in which.

Schematic diagrams are used for clarity, showing only those details that are essential to the understanding of the invention. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Figure 1:
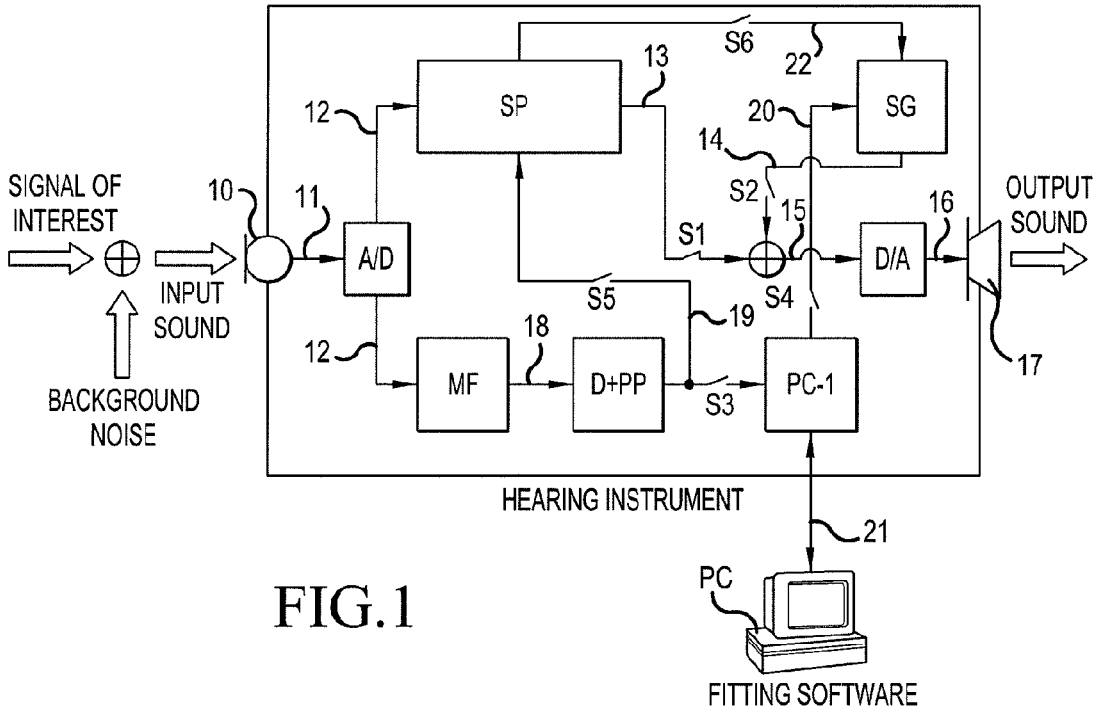
FIG. 1 shows an embodiment of a hearing aid system according to the invention wherein a signal source (or signal of interest) is located outside the hearing instrument.

FIG. 1 shows an embodiment of a hearing aid system according to the invention wherein a signal source (or signal of interest) is located outside the hearing instrument.

FIG. 1 is a general diagram of an embodiment of a hearing aid system according to the invention. The hearing aid system comprises a Hearing Instrument (enclosed by a solid rectangle above the Hearing Instrument reference) comprising a forward path comprising

- a microphone 10 for converting an Input sound signal comprising an information signal (Signal of interest in FIG. 1) that is mixed with background noise (Background noise in FIG. 1) to an analogue electrical input signal 11,
- an A/D converter for converting the analogue electrical input signal 11 to a digital input signal 12,
- a signal processing unit (SP) at least for adapting the digital input signal 12 to a user's hearing profile and providing a processed output signal 13,
- a signal generator (SG) for generating a predefined signal 14, which (when switch S2 is closed) can be added to the processed output signal 13 from the signal processing unit thereby (when switch S1 is also closed) generating a SUM-output signal 15 for a (optional) D/A converter providing an analogue electrical output signal 16, and
- a receiver 17 for generating an Output sound signal for presentation to the user. In a particular configuration, the output signal 14 from the signal generator (SG) can be connected solely to the D/A converter to generate a predefined output sound signal (by opening switch S1, i.e. without addition of the output signal 13 from the signal processing unit).

The signal from the signal generator can in principle be of any known waveform, e.g. describing a periodic function in time ($s(t)=s(t+m\cdot T_0)$, where m is an integer and $T_0$ a time period), such as a Sine.

Further, an alternative path (to the signal path) is shown taking its input from the A/D-converter (in the form of the digital input signal 12) and comprising a matched filter (MF), matched to the waveform generated by the signal generator (SG), where the output 18 of the matched filter is fed to a detector and post-processing unit (D+PP), whose output 19 (when switch S3 is closed) is connected to a PC interface (PC-I) connectable to a PC comprising Fitting Software and to the signal processing unit (when switch S5 is closed). In FIG. 1, a PC is—via a wired or wireless connection 21—connected to the hearing aid via the PC Interface of the hearing aid. Fitting software located on the PC is used to "fit" the hearing aid to a hearing profile of an end user (e.g. to determine and set processing parameters of the signal processing unit, etc.). A (possibly two-way) connection between the Fitting software on the PC via connection 21 to the PC interface (PC-I) in the hearing instrument can be established to the signal generator (SG) via connection 20 (when switch S4 is closed), thereby providing a possibility to control the signal generator from the fitting software and optionally to forward the predefined signal from the signal generator to the Fitting software. In an alternative embodiment, the signal generator (SG) can be controlled by a control signal 22 from the signal processing unit SP (via switch S6 in a closed condition).

The switches S1-S6 are symbolic components for electrically (e.g. digitally) connecting (enabling) or disconnecting (disabling) the two sides of the switch. The switch functions can by physically implemented in any appropriate way. Some or all of the individual switches can be controlled by the signal processing unit or via the fitting software (or implemented in software).

The detector part of the detector and post-processing unit (D+PP) can e.g. rectify or square its input signal and then feed it into a short-time integrator that applies one of the known numeric integration schemes in order to obtain a level estimate. The post-processing unit retrieves the actually desired information from the resulting detector output. For example, the post-processing unit could be a comparator whose output is "signal detected", if the detector's output exceeds a certain threshold or it could be a decision unit deciding whether the signal level is sufficient for a reliable measurement.

The detector (possibly in combination with the signal generator) can be used for measuring the level of or detecting the presence of a signal of known waveform, e.g. while the Hearing Instrument is worn. Including the matched filter in the alternative path improves the signal to noise ratio between the signal of known waveform and Background noise from the environment. The improved measurement or detection can be used for different applications or modes of operation, some of which are briefly exemplified in the following:

1. Critical Gain Measurement Mode

In this mode, the HI does not operate in a normal way (see also the example below with reference to FIG. 2). The signal generator (SG) and receiver 17 are used to produce a tone (output sound signal) that will be measured at the input (open loop measurement, which means that the user of the hearing instrument does not hear the input from the microphone). The signal processing block (cf. FIG. 2) is not used in this case. The measurement is e.g. controlled by the PC (fitting software) and the results can for example be displayed on the PC screen. The embodiment of a hearing aid according to the invention shown in FIG. 2 corresponds to the hearing aid of FIG. 1 with switches S1 open, S2 closed, S3 closed, S4 closed, S5 open and S6 open.

2. "Automatic" Mode

In this mode the HI is worn by the user, and operates normally—adapting incoming sound according to the needs of the user. The HI is not necessarily connected to the fitting software. In parallel, the improved measurement (involving the matched filter and the detector and post-processing unit) identifies a special pattern from the background noise by attenuating noise influences in the matched filter and then routing the matched filter's output signal into a level meter that would for example square this signal and do short time integration on the result. The information extracted in this way can be used, for example, to adjust the signal processing (cf. FIG. 3). The embodiment of a hearing aid according to the invention shown in FIG. 3 corresponds to the hearing aid of FIG. 1 with switches S1 closed, S2 closed, S3 open, S4 open, S5 closed and S6 closed.

3. "Live Demonstration" Mode

In this mode, the HI is located behind or in the ear of a user (i.e. in normal operation) and is connected to the fitting software on the PC via the PC Interface (cf. e.g. FIG. 1 with switches S2, S4, S5 S6 open and switches S1 and S3 closed). The improved measurement identifies a special pattern out of background noise by attenuating noise influences in the matched filter and then routing the matched filter's output signal into a level meter that would for example square this signal and do short time integration on the result. The result of the measurement in the level meter does not change the signal processing, but the information is used in the fitting software to demonstrate functionality. For example, there are Hearing Instruments with so-called directional microphones, suppressing sound coming from behind the Hearing Instrument wearer while amplifying sound normally when it comes from sources in front of the wearer. This can be demonstrated by placing loudspeakers around the Hearing Instrument wearer, playing signals through different loudspeakers and measuring the level of the input signal from the input transducer of the Hearing Instrument in order to compute the attenuation that has been applied to a signal from a certain direction by the directional microphone. For example, the fitting software could control sounds coming from the different loudspeakers, conduct measurements of the signal level by means of the Hearing Instrument's "Detector+Post-processing" (D+PP) unit, compute the attenuation applied by the directional microphone and display the results on the PC screen. This application suffers from acoustic background noise in the room where the Hearing Instrument wearer and the loudspeakers are located. The invention allows using a matched filter for filtering the sound currently coming from one of the loudspeakers out of the background noise. In the given example, this can improve accuracy of level measurements and thus the demonstration of the directional microphone's operation.

EXAMPLE

"Critical Gain Measurement"

Figure 2:
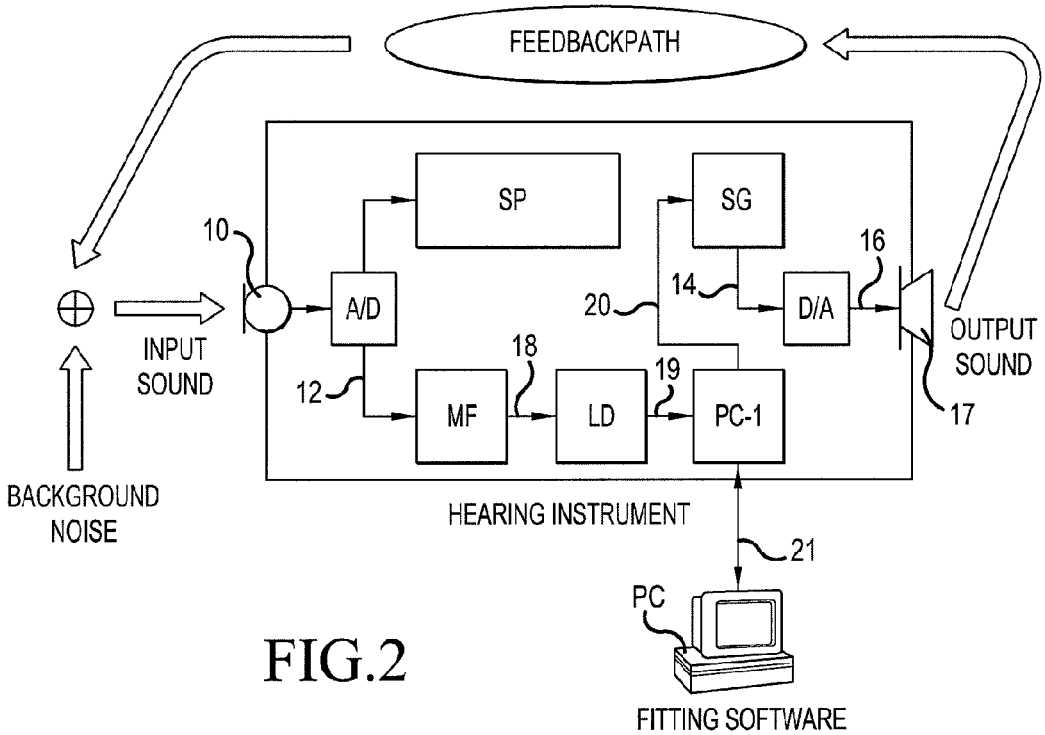
FIG. 2 is an illustration of a critical gain measurement using a hearing aid system according to an embodiment of the invention.

FIG. 2 is an illustration of a critical gain measurement using a hearing aid system according to an embodiment of the invention. The components of the hearing instruments shown in FIG. 2 are identical to those shown in FIG. 1, but their interconnection is different. The Detector+Post-processing unit of FIG. 1 is substituted by a Level detector (LD) in FIG. 2. The purpose of the Level detector is to measure level of signal produced by the signal generator that is picked up by the Hearing Instrument's input transducer. Subtracting the level of the signal that was produced by the signal generator from the measurement result on the dB scale yields an estimate of the transfer function between signal generator and Level detector at the frequency or frequency range of the signal emitted by the signal generator. The Level detector can be implemented as follows: its input signal is rectified or squared and then passed to a short-time integrator that applies one of the known numeric integration schemes in order to obtain a level estimate. In FIG. 2, the processed output from the Signal Processing unit (SP) is not coupled to the D/A-converter. In this embodiment, the signal generator (here a Sine Generator) is controlled by the Fitting Software of the PC, which is coupled to the Hearing Instrument via the PC Interface. The coupling between PC and Hearing Instrument can be a wired or wireless, one- or two-way connection (here shown as a two-way connection). In the mode of operation illustrated by FIG. 2, the Sine Generator generates a tone, which—via the (optional) D/A converter—is converted to an output sound signal by the receiver. An acoustical feedback path (Feedbackpath) from the receiver to the microphone is indicated in FIG. 2, whereby the input sound signal to the microphone of the Hearing Instrument is the sum of the acoustic signal of the Feedbackpath and the Background noise signal.

This signal source is here shown to be located inside the Hearing Instrument (in the form of the Sine Generator and the receiver). Alternatively, the signal generator could be located outside of the hearing aid (e.g. in the form of a computer loudspeaker).

The purpose of the Critical Gain Measurement is to determine the maximum gain that can be applied in fitting, before the Hearing Instrument starts to whistle because of feedback. Once this maximum gain (here called "Critical Gain") has been measured, it can be used for preventing application of gain so high that it would cause feedback. This can be done by

- Showing a comparison between the Hearing Instrument's current gain and the Critical Gain in the Fitting Software's user interface to assist the Fitting Software's user in manually setting Gain of the Hearing Instrument below Critical Gain
- Offering a function in the Fitting Software that automatically sets the Gain of the Hearing Instrument below Critical Gain.
- Offering gain controls in the Fitting Software that are automatically limited in such way that the Fitting Software's user cannot set the Gain of the Hearing Instrument above Critical Gain.

The above ways of keeping the gain of the Hearing Instrument below Critical Gain can be extended by the concept of a "safety margin", in which the gain of the Hearing Instrument is kept below Critical Gain and its difference to Critical Gain is kept above a certain limit.

A classic Critical Gain Measurement works as follows:

A Sine Generator is used to generate a tone of frequency "f" at the Hearing Instrument's output.

The measurement instrument at the input is used to measure the level of the resulting HI input signal.

Critical Gain at frequency "f"=The difference between the level of the generated tone and the level of the measured input signal on a dB scale (other comparisons of the two signals than in dB is of course strictly possible).

The fitting software—here illustrated as being located on an external PC communicating with the hearing aid via a PC-interface—controls the "Critical Gain Measurement", which forms part of the fitting process.

In an aspect of the invention the following change is introduced:

A filter is designed as a "matched filter" for receiving the generated tone. This matched filter is used to filter the Hearing Instrument's input signal.

A formula for computing the matched filters impulse response is provided below:

In a continuous-time view, if the signal generated by the signal source is "s(t)", then the idealized matched filters impulse response is equal to "s(−t)".

In the given example, the signal generated by the signal source is a sine wave of given frequency and the signal processing is digital, thus operates in discrete time. Here, the matched filter could be implemented digitally as Finite Impulse Response (FIR) filter with a certain number N of coefficients with index n from 0 to (N−1). These coefficients—referred to as Coefficient(n)—could be set according to:

$$\text{Coefficient}(n)=A*\sin(2*\pi*f*n/f_s+\phi)*\text{window}(n),$$

where

"A" is a scale factor used to minimize quantization noise and/or to calibrate the measurement "f" is the frequency of the tone generated by the signal source "$f_s$" is the sampling rate of the signal processor "$\phi$" is a phase offset which can be adapted to optimize filter performance "window(n)" is a common "window function" (also called "windowing function"), which is well-known in signal processing theory (e.g. rectangular window, hamming window, etc.).

Examples of windowing functions with appropriate frequency response characteristics are discussed in e.g. J. G. Proakis, D. G. Manolakis, Digital Signal Processing, Prentice Hall, New Jersey, 3rd edition, 1996, ISBN 0-13-373762-4, chapter 8.2.2 Design of Linear-Phase FIR filters Using Windows, pp. 623-630.

EXAMPLES

"Automatic/Normal Mode"

Figure 3:
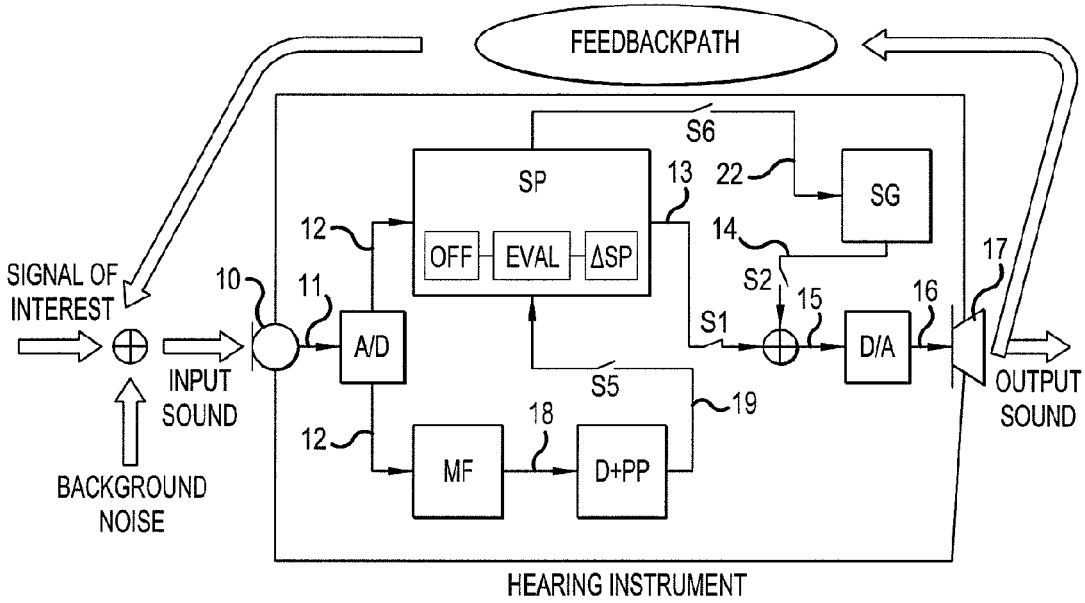
FIG. 3 shows an illustration of a configuration of a hearing aid system according to an embodiment of the invention in a normal operating mode.

FIG. 3 shows an illustration of a configuration of a hearing aid system according to an embodiment of the invention in a normal operating mode. As illustrated in FIG. 3, a signal generator (SG) in the Hearing Instrument generates a predefined source signal 14, which is transformed to an output sound by the Hearing Instrument's output transducer 17. By measuring the level of that signal at the input transducer 10 of the Hearing Instrument, certain properties of the acoustic path (Feedbackpath) can be determined (e.g. transfer function and average gain). The measurement accuracy can be improved if the input signal is passed through a matched filter (MF) before the level measurement (in the detector unit D+PP), as is the case in the embodiment of FIG. 3. The measured properties of the acoustic path can be used to analyze the Hearing Instrument wearers current acoustic environment and to react to it appropriately. This is illustrated in FIG. 3 in that the output 19 of the signal and post processing unit D+PP is fed to the signal processing unit SP (switch S5 being closed). For example:

In an embodiment, the Hearing Instrument uses the measured information to automatically assess changes in feedback path while the Hearing Instrument is being worn, and, based on the result, to automatically optimize amplification or feedback cancellation with the goal of reducing feedback. This is illustrated in FIG. 3 in that the output 19 of the signal and post processing unit is used as input to an evaluation block (EVAL) in the signal processing unit for evaluating the detector signal with a view to the current acoustic environment and by modifying the signal processing accordingly (cf. ΔSP block). The evaluation unit may comprise a memory wherein characteristics of relevant acoustic environments are stored for comparison with current values of the detector signal. Based on such comparison and predefined criteria, one or more signal processing parameters can be modified.

In an embodiment, the measured properties are compared with the reference data collected while the Hearing Instrument was being worn and stored in the memory of the evaluation unit. Whenever this comparison shows significant (predefined) differences (for example whenever the sum of squared differences between the measured acoustic path transfer function and an accorded reference function at selected frequencies exceeds a certain predefined threshold), the Hearing Instrument automatically concludes that it is currently not being worn and an automatic power-off to conserve the battery is triggered (cf. the ON/OFF-switch block (OFF) in FIG. 3).

Figure 5:
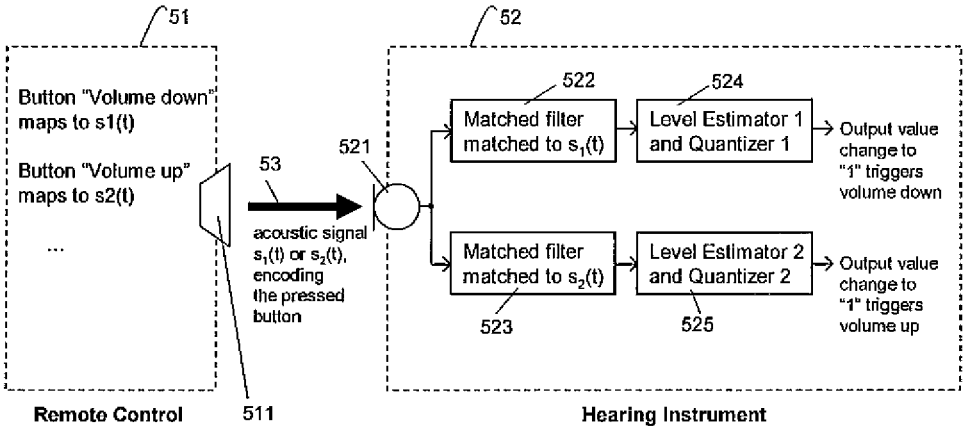
FIG. 5 shows an embodiment of a hearing aid system according to the invention comprising a remote control unit adapted to control the volume of a hearing aid with acoustic signals.

The matched filter could also be used in implementing an acoustic remote control for Hearing Instruments (cf. FIG. 5): In this example, a signal generator would be placed in a remote control 51, the remote control comprising a speaker 511 generating an acoustic signal 53 of known waveform in a frequency range inaudible to the human ear. The Hearing Instrument 52 could (or is adapted to) identify the known waveform of the remote control signal from the sound picked up by its input transducer 521 and react to it by modifying its behaviour. A matched filter in combination with a level detector and a 1-bit quantizer could be used to identify the remote control signal, where a reaction could be triggered whenever the quantizer output changes from "0" towards "1". For example, the Hearing instrument could change volume and/or change listening program on detecting such remote control signals. In this example different waveforms could be used to encode different remote control commands. This would require different matched filters to distinguish the different remote control commands, each filter being matched to the waveform assigned to a single remote control command. This in turn leads to a number of different level detectors and quantizers. In FIG. 5 this is illustrated by the two buttons 'Button "Volume down" maps to $s_1(t)$' and 'Button "Volume up" maps to $s_2(t)$' in the Remote Control 51 and the corresponding acoustic signals 53 $s_1(t)$ or $s_2(t)$ dependent on the pressed button. In the Hearing Instrument 52, two corresponding sets of Matched filter matched to $s_i(t)$, i=1, 2, respectively, (522; 524), and Level Estimator i & Quantizer i, i=1, 2, respectively, (523; 525) are indicated, the two resulting outputs representing a volume up and a volume down regulation. Good distinction between remote control commands could be achieved by assigning the commands to so-called pseudo-orthogonal signals, which are used in telecommunications engineering, for example in the Code Division Multiple Access (CDMA) medium access control scheme.

The physical implementation of a hearing aid according to the present invention as, for example, embodied in the Hearing Instrument of FIGS. 1, 2 and 3 (and comprising the components enclosed by the solid rectangle above the Hearing Instrument reference in FIGS. 1-3) can be made in a variety of ways. In one embodiment, the hearing instrument is body worn or capable of being body worn. In another embodiment, the hearing instrument is adapted to be worn at or fully or partially in an ear canal. In yet another embodiment, the hearing instrument comprises at least two physically separate bodies, which are capable of being in communication with each other by wired or wireless transmission (be it acoustic, ultrasonic, electrical of optical). In still another embodiment, the microphone is located in a first body and the receiver in a second body of the hearing instrument. In an embodiment, the microphone and the receiver are located in the same physical body. The term 'two physically separate bodies' is herein taken to mean two bodies that have separate physical housings, possibly not mechanically connected or alternatively only connected by one or more guides for the acoustical, electrical or optical propagation of signals. In an embodiment, a hearing aid system can comprise two hearing instruments adapted for being located one at each ear of a user.

Figure 4:
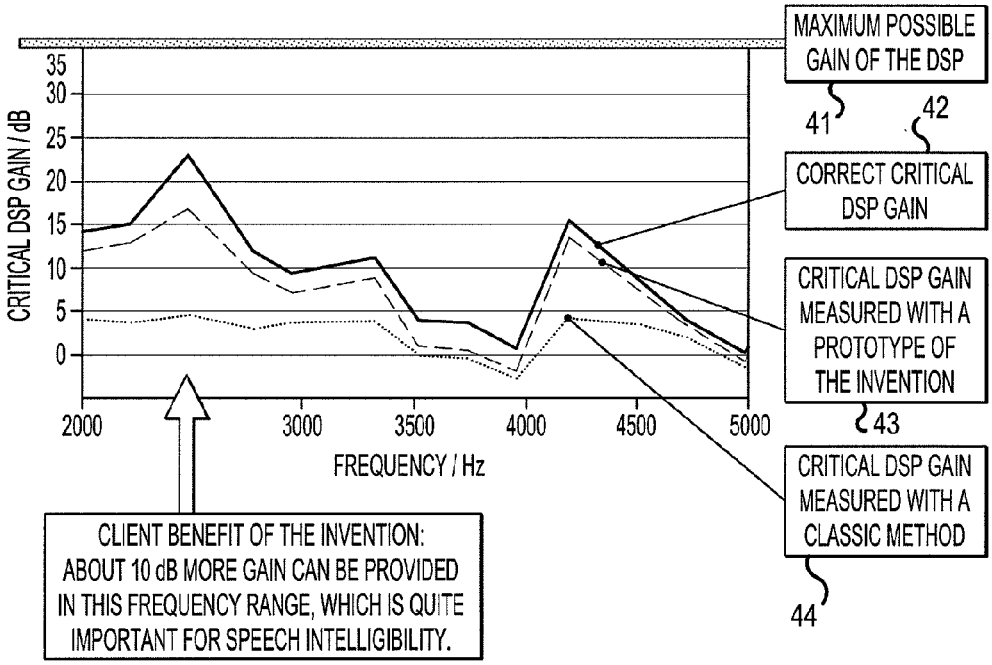
FIG. 4 shows an example of the improvement in Critical Gain measurement accuracy achieved by means of a hearing aid system according to an embodiment of the invention.

FIG. 4 shows an example of the improvement in Critical Gain measurement accuracy achieved by means of a hearing aid system according to an embodiment of the invention. The top graph 41 (bold solid line) shows the maximum possible gain of the signal processing unit (SP in FIGS. 1-3). The second graph from the top 42 (solid line) shows the correct critical gain of the signal processing unit. The third graph from the top 43 (dashed line) shows the critical gain of the signal processing unit as measured with an embodiment of a hearing aid system according to the invention. The bottom graph 44 (dotted line) shows critical gain of the signal processing unit measured with the classic method. The figure illustrates that the improved measurement accuracy may result in more gain being available to the hearing aid wearer. In the shown example, the user could benefit from 10 dB more gain at certain frequencies.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, and may be embodied in other ways within the subject-matter defined in the following claims. For example, although the embodiments are shown to be mainly based on digital components, the principles of using a matched filter in an alternative path to the signal path for evaluating an input signal of a hearing aid system may be implemented using at least some analogue components, including an analogue matched filter (cf. e.g. Hahm et al.). Likewise, the principles may be used in other listening devices comprising a processing of an input sound (e.g. from the environment), e.g. a headset or an active earplug.

References

W. L. Melvin, IEEE A&E Systems Magazine, Vol. 19, No. 1, January 2004, page 19-35.

L. Turin, IRE Transactions on Information Theory, Vol. 6, No. 3, June 1960, page 311-329.

M. D. Hahm, E. G. Friedman, E. L. Titlebaum, A Comparison of Analog and Digital Circuit Implementations of Low Power Matched Filters for Use in Portable Wireless Communication Terminals, *IEEE Transactions on Circuits and Systems-II*, Volume 44, Issue 6, June 1997, page 498-506.

J. G. Proakis, D. G. Manolakis, Digital Signal Processing, Prentice Hall, New Jersey, 3rd edition, 1996, ISBN 0-13-373762-4.

M. Bertges-Reber, Boundaries of real open fittings: Clinical experiences, *Hearing Review*, Vol. 13, No. 2, February 2006, page 44-47

The invention claimed is:

1. A hearing aid system, comprising:

an input transducer inside a hearing aid for converting an input sound signal into an electrical input signal, the input sound signal including an information signal part of a known waveform and a background noise part;

an A/D converter for converting the electrical input signal to a digital input signal;

a signal path including a signal processing unit for processing the digital input signal to at least adapt the digital input signal to a hearing profile of a user of the hearing aid, the signal processing unit providing a processed output signal;

an output transducer configured to convert a digital or analogue electrical output signal to an output sound signal;

a signal generator inside the hearing aid configured to generate a predefined source signal, the predefined source signal being added to an output of the signal processing unit or being directly provided as input of the output transducer;

a matched filter matched to the known waveform receiving said electrical input signal in analogue or digital form, the matched filter configured to improve the identification of the information signal part of the known waveform from the noisy input signal; and an adder configured to add the source signal to the output of the signal processing unit, wherein the information signal part of the known waveform is generated by said signal generator.

2. A hearing aid system according to claim 1, further comprising:

a D/A converter for converting a processed output signal to an analogue electrical output signal.

3. A hearing aid system according to claim 1, further comprising:

a selective connection configured to provide that the source signal is connected directly to the D/A converter or output transducer.

4. A hearing aid system according to claim 1, wherein the signal generator is configured to generate a signal with a predefined waveform s(t).

5. A hearing aid system according to claim 4, wherein the matched filter has an impulse response of a predefined shape $s(-t+\Delta t)$ for a certain range of t, where $\Delta t$ is a certain time delay.

6. A hearing aid system according to claim 1 comprising an alternative path comprising the matched filter.

7. A hearing aid system according to claim 2, wherein the digital input signal is fed to the matched filter.

8. A hearing aid system according to claim 6 wherein the alternative path further comprises a detection unit for evaluating the signal from the matched filter.

9. A hearing aid system according to claim 8 wherein the output of the matched filter is fed to the detection unit.

10. A hearing aid system according to claim 8 wherein the output of the detection unit is connectable to the signal processing unit.

11. A hearing aid system according to claim 1 wherein the signal processing unit is connectable to the signal generator to allow the signal generator to be controlled from the signal processing unit.

12. A hearing aid system according to claim 1, further comprising:

a programming interface to an external programming unit.

13. A hearing aid system according to claim 12 wherein the output of the detection unit is connectable to the external programming unit via the programming interface.

14. A hearing aid system according to claim 12 wherein the signal generator is connectable to the external programming unit via the programming interface.

15. A hearing aid system according to claim 8, wherein the detection unit comprises an evaluation part for evaluating the detected signal from the matched filter to define the current acoustic environment of the hearing aid system based on a comparison with values of the detected signal from the matched filter for pre-defined acoustic environments stored in a memory.

16. A hearing aid system according to claim 8, further comprising:

a post-processing unit configured to modify the adaptation of the input signal to a user's hearing profile performed by the signal processing unit based on the output of the detection unit.

17. A hearing aid system according to claim 16, wherein the hearing aid system is switched into a low power mode based on pre-defined criteria.

18. A method of reducing feedback in a hearing aid system based on a critical gain measurement, on a hearing aid including an input transducer for converting an input sound signal to an electrical input signal, a signal generator inside the hearing aid configured to generate a predefined source signal, the predefined source signal being added to an output of the signal processing unit or being directly provided as input of the output transducer, and an output transducer for converting a processed electrical output signal to a processed sound output, the method comprising:

generating a source signal having a predefined waveform s(t) with the signal generator inside the hearing aid;

converting the generated source signal into an acoustic signal having a predefined output level $P_o$ with the output transducer of the hearing aid and a predefined frequency or bandwidth;

measuring the input level $P_i$ of the generated sound at the input transducer as determined by the level of the electrical input signal from the input transducer of the hearing aid;

the critical gain at the frequency or in the frequency band of the generated sound as the difference $P_o$-$P_i$ between the output and input levels on a dB scale, where the critical gain is defined as the maximum difference between the output and input sound levels on a dB scale above which the hearing aid starts to howl due to acoustic feedback;

varying the frequency or frequency band of the generated sound to obtain a relationship between frequency and critical gain, wherein the measuring the input level $P_i$ of the generated sound at the input transducer includes using a matched filter which is adapted to receive the generated sound by having an impulse response $s(-t+\Delta t)$ for a certain range of t, where $\Delta t$ is a certain time delay.

19. A method according to claim 18 wherein the predefined waveform s(t) is periodic in that $s(t)=s(t+m\cdot T_0)$, where m is an integer and $T_0$ is a time period.

20. A method according to claim 18 wherein the hearing aid comprises a signal path comprising a signal processing unit for adapting the input signal to a user's hearing profile and an alternative path comprising the matched filter.

21. A method according to claim 18, further comprising:

communicating with a programming unit whereon fitting software runs and from which the gain measurement can be controlled.

22. A method according to claim 18, wherein $\Delta t$ is in the order of the group delay of the matched filter.

23. A method according to claim 18, further comprising:

evaluating a signal from the matched filter in a detector unit.

24. A method according to claim 20, further comprising:

evaluating a detector signal output from a detector unit by the signal processing unit with a view to the current acoustic environment; and modifying the signal processing in accordance with said evaluating the detector signal.

25. A method according to claim 24, further comprising:

storing characteristics of relevant acoustic environments for comparison with current values of the detector signal;

comparing the stored characteristics with the current values of the detector signal; and modifying one or more signal processing parameters based on said comparing and predefined criteria.

26. A method according to claim 23, further comprising:

switching the hearing aid system into a low power mode based on pre-defined criteria and a comparison of current output signals from the detector unit with stored ones for active acoustic environments.

27. A hearing aid system according to claim 17, wherein said predefined criteria include a comparison of current output signals from the detector with stored signals representative of active acoustic environments.

28. A hearing aid system according to claim 17, wherein a low power mode is a mode where power consumption is reduced to less than 20% of normal power consumption.

29. A hearing aid system according to claim 17, wherein the hearing aid is completely switched off.

* * * * *